US005643546A

United States Patent [19]

Yamamoto et al.

[11] Patent Number: 5,643,546

[45] Date of Patent: *Jul. 1, 1997

[54] PITCH-TYPE CARBON FIBERS AND PROCESS FOR THEIR PRODUCTION

[75] Inventors: Iwao Yamamoto; Hiroyuki Aikyo; Akihiko Yoshiya, all of Yokohama; Kazuo Shirosaki, Sagamihara, all of Japan

[73] Assignee: Mitsubishi Chemical Corporation, Tokyo, Japan

[*] Notice: The portion of the term of this patent subsequent to Sep. 30, 2014, has been disclaimed.

[21] Appl. No.: 329,185

[22] Filed: Oct. 26, 1994

Related U.S. Application Data

[62] Division of Ser. No. 315,490, Sep. 30, 1994, which is a continuation of Ser. No. 996,166, Dec. 23, 1992, abandoned.

[30] Foreign Application Priority Data

| | | | |
|---|---|---|---|
| Dec. 25, 1991 | [JP] | Japan | 3-343660 |
| Dec. 25, 1991 | [JP] | Japan | 3-357039 |
| Feb. 13, 1992 | [JP] | Japan | 4-026927 |
| Feb. 14, 1992 | [JP] | Japan | 4-059687 |
| Aug. 12, 1992 | [JP] | Japan | 4-215018 |

[51] Int. Cl.[6] ..... D01F 9/12

[52] U.S. Cl. ..... 423/447.2

[58] Field of Search ..... 423/447.2, 447.4

[56] References Cited

U.S. PATENT DOCUMENTS

| | | | |
|---|---|---|---|
| 4,032,430 | 6/1977 | Lewis | 423/447.1 |
| 5,213,677 | 5/1993 | Yamamoto et al. | 423/447.4 |
| 5,348,719 | 9/1994 | Yamamoto et al. | 423/447.4 |

*Primary Examiner*—Michael Lewis
*Assistant Examiner*—Stuart L. Hendrickson
*Attorney, Agent, or Firm*—Oblon, Spivak, McClelland, Maier & Neustadt, P.C.

[57] ABSTRACT

A pitch-type carbon fiber made from a pitch having ① a glass transition temperature width of at most 40° C. as measured by a differential scanning calorimeter, ② a proportion of the optically anisotropic phase of at least 10% by volume, and ③ a quinoline-insoluble content of at most 5% by weight, as a spinning raw material pitch.

3 Claims, 3 Drawing Sheets

PITCH-TYPE CARBON FIBERS AND PROCESS FOR THEIR PRODUCTION

This is a division of application Ser. No. 08/315,490 filed on Sep. 30, 1994, a FWC, of application Ser. No. 07/996,166 filed on Dec. 23, 1992, now abandoned.

The present invention relates to carbon fibers and a process for their production. More particularly, it relates to pitch-type carbon fibers excellent particularly in the compression strength and a process for their production.

Heretofore, carbon fibers and graphitized fibers have been used as reinforcing material for various composite materials by virtue of their excellent properties such as light weight, high elasticity and high rigidity. For example, they have been widely used for sporting goods such as golf clubs or tennis rackets, medical articles such as artificial hands or artificial legs as well as structural materials such as vehicles, aircrafts and spaceships. High performance carbon fibers are generally classified into polyacrylonitrile (PAN) type and pitch-type. Among them, pitch-type carbon fibers and graphite fibers are prepared from a pitch obtained from coal or petroleum, as the raw material. Such a raw material is, for example, heated to form therein optically anisotropic phase portions of liquid crystal as a precursor structure of a graphite structure, and it is then spun and then subjected to infusible treatment under a oxidizing atmosphere, followed by carbonization and, if necessary, graphitization, to obtain high performance carbon fibers. Here, the reason for forming optically anisotropic phase portions is that the optically anisotropic phase portions in the form of liquid crystal have orientation, and the resulting carbon fibers will likewise have excellent orientation, whereby high strength can readily by attained. For example, Japanese Unexamined Patent Publication No. 36170/1974 discloses that high performance carbon fibers can be obtained by using a pitch wherein the optically anisotropic phase portions constitute from 40 to 90%.

With respect to the production of such spinning pitch containing a large amount of the optically anisotropic phase, it is already known to produce a spinning pitch by heat-treating carbonaceous raw material while stirring or while stirring and further blowing an inert gas or the like thereinto, as disclosed in Japanese Unexamined Patent Publications No. 42924/1982 and No. 168687/1983, or to produce a spinning pitch by heat-treating carbonaceous material and then applying an aromatic solvent to recover the solvent-insoluble matter by the solvent separation, as disclosed in Japanese Examined Patent Publications No. 5433/1988 and No. 53317/1989.

Further, in recent years, it has been known to obtain carbon fibers by using as the starting material a synthetic pitch having optical anisotropy obtained from a raw material such as naphthalene, as disclosed in e.g. Japanese Unexamined Patent Publication No. 83319/1986 or a synthetic pitch having optical anisotropy obtained from a raw material prepared by crosslinking and polymerizing an alkylbenzene with formaldehyde, as disclosed in Japanese Unexamined Patent Publication No. 315614/1988.

Further, Japanese Unexamined Patent Publications No. 146920/1988 and No. 83319/1986 disclose a process for producing a spinning pitch which comprises polycondensing a condensed polycyclic hydrocarbon or a material containing such a hydrocarbon by means of a Lewis acid catalyst such as $HF{\cdot}BF_3$ or $AlCl_3$, then removing the catalyst, followed by heat treatment under an inert gas stream.

However, such conventional pitch fibers are inferior in the compression strength to PAN-type fibers although they may be equal in the tensile strength or the elastic modulus. A further improvement in this respect has been desired.

The present inventors have conducted extensive studies with an aim to improve the compression strength of pitch-carbon fibers. As a result, it has been made possible to provide pitch-type carbon fibers which are not only excellent in the tensile strength and elastic modulus but also comparable to PAN-type fibers also in the compression strength. Namely, the present inventors have found that such an objective can be accomplished by using an optically anisotropic pitch having uniform properties, which does not substantially contain a heavy component such as a quinoline-insoluble content and abnormal elements such as oxygen, nitrogen or sulfur other than carbon and hydrogen elements and which has a narrow width of the molecular weight distribution, and the present invention has been accomplished on the basis of this discovery.

Namely, it is an object of the present invention to provide pitch-type carbon fibers which are excellent in the tensile strength, compression strength and elastic modulus.

Such an object can readily be accomplished by a pitch-type carbon fiber made from a pitch having ① a glass transition temperature width of at most 40° C. as measured by a differential scanning calorimeter, ② a proportion of the optically anisotropic phase of at least 10% by volume, and ③ a quinoline-insoluble content of at most 5% by weight, as a spinning raw material pitch.

Figure 1:
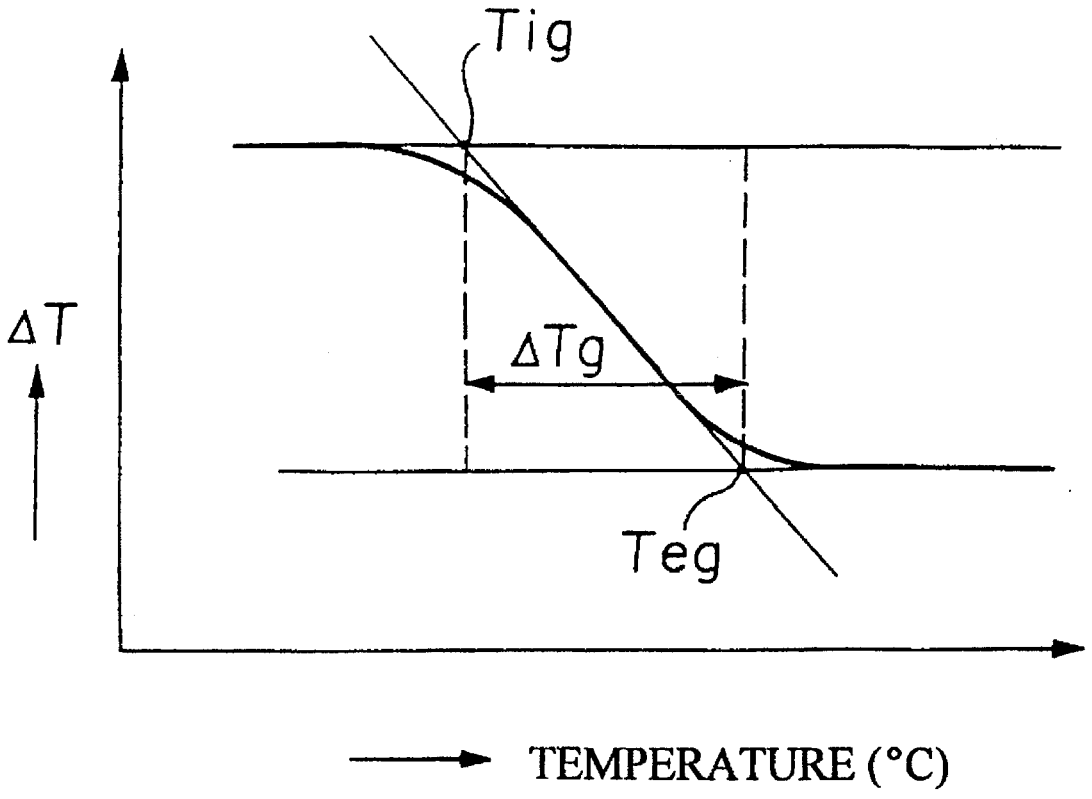
FIG. 1 is a graph illustrating the method for determining the glass transition temperature width ($\Delta T_g$).

Now, the present invention will be described in detail with reference to the preferred embodiments.

The starting material for the carbonaceous raw material to be used in the present invention may, for example, be coal-type coal tar, coal tar pitch, a liquefied product of coal, petroleum-type heavy oil, pitch, a thermal polycondensation reaction product of petroleum resin or a polymerization reaction product of naphthalene and anthracene by a catalytic reaction. These carbonacious materials contain impurities such as free carbon, non-soluble coal, an ash content and a catalyst. It is advisable to preliminarily remove such impurities by a conventional method such as filtration, centrifugal separation or sedimentation separation by means of a solvent.

Further, the carbonaceous material may be subjected to pretreatment by e.g. a method wherein after heat treatment, a soluble matter is extracted with a certain specific solvent, or a method wherein it is hydrogenated in the presence of a hydrogen donative solvent or hydrogen gas. As the starting material for the raw material pitch to be used in the present intention, it is particularly preferred to employ condensed polycyclic hydrocarbons with a view to removal of impurities. Among them, particularly preferred are naphthalene, anthracene, phenanthlene, acenaphthene, pyrene, acenaphthylene and alkyl-substituted compounds thereof. These materials may be used alone or in combination as a mixture of two or more of them. Preferably, they may be used substantially alone. The reason is that, for example, naphthalene and anthranene will produce different types of polymers when subjected to polycondensation in the next step. Among these raw material pitches, particularly preferred is naphthalene.

In a case where the starting material for such carbonaceous raw material is a condensed polycyclic hydrocarbon, it is poly-condensed in the presence of a Lewis acid catalyst preferably at a temperature of from room temperature to 300° C., and any further necessary treatment is applied to obtain a pitch having desired physical properties. The Lewis acid catalyst may, for example, be $SO_3$, $BF_3$, $AlCl_3$, $AlBr_3$, $SnCl_4$, $FeCl_3$, $ZnCl_2$, $SO_2$, $Li^+$, $Na^+$, $Ag^+$, $Fe^{3+}$, $Al^{3+}$, $Cu^{2+}$, $Hg^+$, $H^+$, $NO^{2-}$ or $HF{\cdot}BF^3$. Among them, $HF{\cdot}BF^3$, $AlCl^3$ or $BF^3$ is particularly preferred.

With respect to the amount of the polycondensation catalyst, the Lewis acid is used in an amount of from 0.01 to 20.0 mols, preferably from 0.1 to 4.0 mols, per mol of the condensed polycyclic hydrocarbon. The temperature for the polycondensation reaction is usually from 100° to 300° C., preferably 150° to 250° C. The time for the polycondensation varies depending upon the type of the raw material, the temperature and the amount of the catalyst, but it is usually from 5 to 300 minutes, preferably from 15 to 180 minutes.

The polycondensation reaction is conducted usually under stirring in a continuous system or batch system reactor. The pressure for the reaction is usually from atmospheric pressure to 100 kg/cm$^2$, preferably from atmospheric pressure to 50 kg/cm$^2$.

It is necessary to remove the Lweis acid catalyst after completion of the polycondensation reaction. This can be done by employing a method wherein the reaction product is washed with water or with an aqueous alkaline solution to remove the catalyst. In a case where the catalyst is a compound having a boiling point such as $HF.BF_3$, it can be removed by distillation.

Further, it is preferred to preliminarily remove raw boiling point compounds such as unreacted reactants contained in the reaction product after completion of the polycondensation reaction by distillation at a temperature of from 50° to 350° C. under atmospheric pressure or reduced pressure.

Further, the reaction temperature, the reaction time and the amount of the catalyst are preferably adjusted so that the softening point of the resulting pitch material will be from 150° to 250° C. as measured by a Mettler method or a flow tester method and the pitch material would be composed substantially of optically isotropic phase. The softening point of the pitch material usually increases as the reaction conditions become severe i.e. as the reaction temperature, the reaction time and the amount of the catalyst increase. However, if the conditions are too severe, it transforms to an optically anisotropic pitch. Especially when the following conditions ① to ③ are to be satisfied by an inert gas blowing method, it is necessary that the pitch material is substantially optically isotropic, and the optical anisotropic phase should better be not more than 30% by volume, preferably not more than 10% by volume, as observed under a polarization microscope (100 to 500 magnifications).

In a process for producing a pitch provided with the characteristics of the present invention, it is common to heat treat the above mentioned carbonaceous starting material usually at a temperature of from 350° to 500° C., preferably from 380° to 450° C., for from 2 minutes to 50 hours, preferably from 5 minutes to 5 hours, in an inert gas atmosphere such as nitrogen, argon, or stream or while blowing such an inner gas thereinto. Any further treatment may be conducted as the case requires, to obtain a pitch having desired physical properties. Such a further treatment specifically is a treatment necessary to satisfy the following conditions:

① The glass transition temperature width is at most 40° C. as measured by a differential scanning calorimeter, ② The proportion of the optically anisotropic phase is at least 10% by volume, and ③ The amount of the quinoline-insoluble content is at most 5%.

There is no particular restriction as to the method, so long as it is thereby possible to obtain the desired pitch. For example, such a pitch can be obtained by separation by means of solvents.

The present invention provides a process for producing a synthetic pitch capable of producing carbon fibers having high compression strength, wherein two types of solvents having a difference in the solubility parameter of at least 0.1 are used in combination to extract from the synthetic pitch a matter which is soluble to the first solvent having the large solubility parameter and which is insoluble to the second solvent having the small solubility parameter.

As the first solvent having a large solubility parameter to be used in the present invention, any solvent may be used without any particular restriction so long as it has a solubility parameter within a range of from 9.5 to 11.5, preferably from 10.0 to 11.0. Specifically, tetralin tetrahydrofuran, chlorobenzene, carbon disulfide, nitrobenzene, pyridine, naphthalene oil, anthracene oil, creosote oil and cleaning oil may, for example, be mentioned. Particularly preferred are pyridine, naphthalene oil, anthracene oil, creosote oil and mixtures thereof.

The second solvent having a small solubility parameter to be used in the present invention, is a solvent of which the solubility parameter is smaller by at least 0.1 than the solubility parameter of the first solvent (the solvent having the large solubility parameter), and the solubility parameter is within a range of from 7.0 to 10.0, preferably from 7.0 to 9.0. Specifically, toluene, hexane, xylene, ethylbenzene, kerosene and mixtures thereof, and solvent mixtures thereof with other solvents having higher solubility parameters. Preferred are the above mentioned solvents having small solubility parameters, a mixture thereof and a mixture of kerosene oil as well as a mixture of kerosene oil and anthracene oil. Particularly preferred is a mixture of toluene and hexane. Specifically, for example, a condensed polycyclic hydrocarbon is polycondensed at a temperature of from room temperature to 300° C. by means of a Lewis acid, and a pyridine-insoluble matter is removed from the resulting pitch, and then a soluble matter is removed by a solvent mixture of toluene and hexane. The mixing ratio of toluene and hexane is usually toluene/hexane=20 volume %/80 volume % to 50 volume %/50 volume %.

In a case where the raw material is coal tar pitch, a coal tar pitch having a toluene-insoluble content of at most 60% by weight, preferably at most 50% by weight, or more preferably a coal tar pitch having hydrogenated to reduce the toluene-insoluble content to a level of at most 30% by weight, is subjected to separation by solvents. The hydrogenation treatment is conducted to adjust the molecular weight of the coal tar pitch and the degree of aromatization. For example, the coal tar pitch may be treated with a hydrogen donative solvent such as tetralin, dihydrophenanthlene, tetrahydroquioline or a hydrogenated aromatic oil, or it is hydrogenated at a temperature of from 360° to 500° C. for from 1 to 24 hours under a hydrogen gas pressure of from 10 to 500 kg/cm$^2$G, preferably from 20 to 300 kg/cm$^2$G, by an addition of a solvent such as quinoline, naphthalene oil or anthracene oil readily convertible to a hydrogen donative solvent and a cocatalyst of iron-type, molybdenum-type, nickel-type, chromium-type, zinc-type or a sulfur compound. Further, a solid content may be removed by e.g. filtration as the case requires, and more preferably, a pretreatment may be conducted by a method for obtaining the residue by removing the solvent by distillation, as the case requires.

Specifically, a method may be mentioned wherein coal tar pitch or its hydrogenated product is treated by a solvent mixture of toluene and hexane to remove a soluble matter. The mixing ratio of toluene and hexane is usually toluene/hexane=90 volume %/10 volume % to 50 volume %/50 volume %. As conditions for the solvent treatment to remove the soluble matter, not only the mixing ratio of toluene and hexane but also the ratio of the solvent to the pitch, the temperature and the time may be mentioned. It is necessary to produce the desired pitch by conducting the solvent treatment by a proper combination of these conditions, then removing the soluble matter by a conventional method such as filtration or centrifugal separation, followed by a method such as heat treatment under reduced pressure. More specifically, to obtain a pitch having the characteristics of the present invention from the above coal tar pitch or from its hydrogenated product, if the ratio of toluene/hexane is small, the object can be accomplished by increasing this solvent ratio, or by increasing the treating temperature or prolonging the treating time. If the ratio of toluene/hexane is large, the object can be accomplished by properly reducing the solvent ratio, the treating temperature or the treating time.

Further, as a specific method for satisfying such conditions ① to ③ by a blowing method, it is important to preliminarily produce an optically anisotropic pitch having uniform properties containing no substantial heavy component such as a quinoline-insoluble matter or no substantial abnormal element such as oxygen, nitrogen or sulfur other than carbon and hydrogen elements and having a narrow width of the molecular weight distribution. For this purpose, it is necessary to preliminarily polymerize the raw material pitch to a softening point of from 100° to 300° C., preferably from 150° to 250° C., by means of a Lewis acid catalyst.

Then, the substantially optically anisotropic pitch having a softening point of from 100° to 300° C., preferably from 150° to 250° C., obtained as described above, is heat-treated while blowing an inert gas thereto. The heat treatment is conducted at a temperature of from 350° to 450° C., preferably from 370° to 430° C. The time for the heat treatment varies depending upon the conditions such as heat treating temperature, but is usually from 2 minutes to 50 hours, preferably from 5 minutes to 5 hours. The treatment is conducted under an inert gas stream such as nitrogen, argon or steam. In such a case, the blowing rate of the inert gas is adjusted to be at least 1.0 Nm$^3$/hr, preferably at least 2.5 Nm$^3$/hr, per kg of the starting material pitch.

Japanese Unexamined Patent publications No. 146920.1988 and No. 83319/1986 disclose a process for producing a spinning pitch, which comprises firstly polycondensing naphthalene by means of a Lewis acid catalyst such as $HF{\cdot}BF_3$ or $AlCl_3$, removing the catalyst, followed by heat treatment under an inert gas stream. However, in such a process, the polymerization reaction treatment by the Lewis acid catalyst in the first step is at a low temperature, or in the thermal polymerization reaction treatment in the second step, no adequate inert gas blowing rate as in the present invention is given, or the thermal treatment conditions are not set so that the optical anisotropy will be at least 10% by weight, preferably at least 70% by weight, whereby it is impossible to obtain a spinning pitch for carbon fibers having high compression strength as in the present invention.

The heat treatment is conducted by adjusting the time and the temperature for the heat treatment so that the resulting spinning raw material pitch has ① a glass transition temperature width of at most 40° C. as measured by a differential scanning calorimeter, ② a proportion of the optically anisotropic phase of at least 10% by volume, preferably at least 70% by volume, and ③ a quinoline-insoluble content of at most 5% by weight.

To obtain a spinning pitch which satisfies the conditions ① to ③, the temperature and the time for the heat treatment, the blowing rate of the inert gas, etc. may be properly adjusted. Specifically, the higher the temperature and the longer the time for the heat treatment, the higher the proportion of the optically anisotropic phase and the amount of the quinoline-insoluble content. Further, the blowing rate of the inert gas is required to be at least 1.0 Nm$^3$/hr, preferably at least 2.5 Nm$^3$/hr, per kg of the raw material pitch. This is a means of effectively removing out of the system the non-reacted component in the polycondensation reaction in the presence of the Lewis acid catalyst in the first step, whereby the molecular weight distribution can be narrowed and the glass transition temperature width can be made at most 40° C. To ensure the effects by blowing the inert gas, it is preferred to effectively disperse the blowing gas in the molten pitch. For this purpose, a method may optionally be employed so that the number of blowing nozzles is increased, or the shape of the stirring vanes is improved to disperse the gas bubbles to small sizes.

The pitch thus obtained is preferably a pitch which shows a shearing viscosity of 200 poise at a temperature of from 220° to 370° C. This is a necessary condition for spinning at a proper temperature.

Such a spinning raw material pitch preferably has a specific structure such that it is composed of fine spherical particles having a diameter of from 0.1 to 100 μm, more preferably from 0.1 to 30 μm and not composed of large domains where the optical anisotropic phase has a flow structure, as is different from many of conventional spinning pitches, and such optically anisotropic fine spherical particles constitute from 5 to 40 volume % of the entirety. The remaining portion may simply have a characteristic such that it looks optically isotropic under a polarization microscope magnified from 100 to 600 times, and it is not particularly limited by the type of the starting carboneceous material or its treating method. To examine the optically anisotropic portion in the pitch test sample under a polarization microscope, the pitch test sample is pulverized to a size of a few mm$^2$ and embedded over the entire surface of a resin in a diameter of 2 cm in accordance with a usual method, and the surface is polished. Then, the entire surface is observed by a polarization microscope (from 100 to 600 magnifications).

The volume proportion of the optically anisotropic portion or the optically anisotropic fine spherical particle portion is determined by measuring the proportion of the area of the optically anisotropic fine spherical particle portion in the entire surface area of the sample. Carbon fibers of the present invention prepared from such a pitch as the spinning raw material, exhibit adequate spinability and high elastic modulus and high 0° compression strength.

The mechanism to produce such excellent physical properties is not clearly understood. However, such physical properties are governed by the size and the orientation of the graphite crystallites constituting the carbon fibers, and to obtain high modulus, graphite crystals are required to be properly aligned in the direction of the carbon fiber axis.

On the other hand, the compression strength of carbon fibers is usually low with the ones having graphite crystals developed to have high modulus. This is believed to be attributable to the fact that in the case of carbon fibers having crystallization progressed, "slippage between hexagonal net faces of graphite crystals" occurs under a compression stress, whereby fracture will result. Accordingly, in order to obtain carbon fibers having high 0° compression strength, it is necessary to control the development of graphite crystals. Especially, the 0° compression fracture caused by the "slippage between hexagonal net faces of graphite crystals" is believed to start from portions where the stress is likely to be concentrated, such as fine voids present in the carbon fibers or defects such as large crystal boundaries.

With a pitch wherein the optically anisotropic phase is in a "flow structure" or a pitch wherein the optically anisotropic portion is spherical particles having a size of at least 100 μm, when such a pitch is stretched by means of a spinning nozzle, optically anisotropic liquid crystals which are the precursor of graphite crystals, are stretched in the direction of the carbon fiber axis, whereby graphite crystals will be oriented in the direction of the fiber axis, and elastic modulus can readily be obtained, but graphite crystals tend to be large, whereby the 0° compression strength of the carbon fibers will be low.

On the other hand, with a spinning pitch wherein optically anisotropic spherical particles of from 0.1 to 100 μm, preferably from 0.1 to 30 μm, constitute from 5 to 40 volume % of the entirety, when such a pitch is stretched from the spinning nozzle, the liquid crystals are stretched in the direction of the fiber axis, and graphite crystals will be properly aligned in the direction of the axis, and yet since the optically anisotropic liquid crystals are small in size and covered with the optically isotropic portion, crystals are prevented from growing more than necessary. It is believed that for this reason, the excellent physical properties i.e. high elastic modulus and high 0° compression strength can be obtained.

Accordingly, if the volume proportion of the optically anisotropic portion exceeds 40%, or the diameter of the optically anisotropic fine spherical particles exceeds 100 μm, the graphite crystal size of the carbon fibers tends to be large, whereby it will be difficult to obtain a product having high 0° compression strength. Further, the spinning pitch is usually stretched from a nozzle having a diameter of from 0.05 to 0.5 mm to obtain a carbon fiber having a diameter of from 5 to 30 μm. However, in the case of a pitch wherein the diameter of the optically anisotropic fine spherical particles exceeds 100 μm, a viscosity irregularity will be created during the process wherein the optically anisotropic portion with high viscosity and the optically isotropic portion with low viscosity are stretched from the forward end of the nozzle, whereby spinning will be difficult. On the other hand, if the volume proportion of the optically anisotropic portion is less than 10%, the orientation in the direction of the fiber axis during spinning will be impaired, whereby it will be difficult to obtain carbon fibers with desired high elasticity.

The spinning pitch having such fine spherical particles is preferably such that optically anisotropic fine spherical particles with a diameter of larger than 3.0 μm as observed by a polarization microscope constitute from 5 to 40 volume % of the entirety, and the remaining portion is a portion wherein optically anisotropic fine spherical particles with a diameter of from 0.2 to 3.0 μm are dispersed, and they constitute from 5 to 100 volume % of said remaining portion. To examine the portion showing the optical anisotropy in the pitch sample by a polarization microscope, the pitch sample is pulverized to a size of a few mm and embedded on substantially the entire front surface of a resin having a diameter of 2 cm in accordance with a usual method, then, the surface is polished and then the entire surface is thoroughly observed under a polarization microscope (at least 100 to 500 magnifications).

The volume proportion of the optically anisotropic portion or the optically anisotropic fine spherical particle portion is determined by measuring the proportion of the area of the optically anisotropic portion or the optically anisotropic fine spherical particle portion in the entire surface area of the sample.

Especially in the case of optically anisotropic fine spherical particles having a diameter of from 0.2 to 3.0 μm, observation is required to be conducted under a polarization microscope magnified to a necessary magnifications of at least 1,000 magnifications. It is usually necessary to employ an objective lens with at least 100 magnifications for dry use or for liquid-immersion use for such a polarization microscope and to employ a photographic projection lens with suitable magnifications so that observation on the film surface will be conducted under at least 2,000 magnifications. In such a case, it is usually preferred to employ a gypsum plate commonly employed for observation under a polarization microscope, so as to facilitate the detection of the optically anisotropic portion.

Further, it is preferred that the turn table on which the sample is placed, is rotated at an angle of 45° each time so that observation is conducted from at least three directions to distinguish the optically anisotropic portion from the isotropic portion to measure the optically anisotropic proportion.

The diameter of an optically anisotropic fine spherical particle can be obtained usually by measuring the size on its polarization microscopic photograph by means of a magnifying glass and dividing the size with the magnifications. The magnifications may be checked by means of a commercially available objective micrometer.

The pitch of the present invention is more preferably such that the proportion of the optically anisotropic portion determined under a polarization microscope of 200 magnifications under a condition heated to a temperature at which the viscosity of the pitch is 200 poise, is at most 10% by volume.

Observation by a polarization microscope conducted under a condition where the pitch sample is heated, is conducted usually by means of a commercially available hot stage and by placing from 5 to 50 mg of a pitch sample in a metal container having a diameter of from 3 to 6 mm, whereupon the sample is heated to the predetermined temperature under a nitrogen atmosphere for the measurement.

The analysis is conducted usually by employing a polarization microscope having an objective lens with 20 magnifications and an eyepiece with 10 magnifications.

By using the pitch having such characteristics, it is possible to obtain a pitch-type carbon fiber having excellent properties with respect to all of the tensile strength, the elastic modulus and the compression strength.

In the present invention, the glass transition temperature width ($\Delta T_g$) is measured by a differential scanning calorimeter. The measurement is conducted in accordance with JIS K7121-1987 "Method for Measuring the Transition Temperature of Plastics". From the DSC curve obtained by this method, the glass transition temperature width ($\Delta T_g$) is obtained as the difference between $T_{ig}$ and $T_{eg}$ as disclosed in FIG. 1 in accordance with JIS K7121-1987 "9.3 Method for Determining the Glass Transition Temperature". Specifically, $T_{ig}$ and $T_{eg}$ (corresponding to a low temperature side base line and a high temperature side base line, respectively) are temperatures at the intersections of linear lines obtained by extending the respective base lines before and after the glass transition, with a tangent line drawn at a point where the inclination of the curve of the stepwisely changing portion of the glass transition is at the maximum level.

The width of the glass transition region i.e. the glass transition temperature width $\Delta T_g$ is obtained as the difference between $T_{ig}$ and $T_{eg}$.

Further, as one of the essential conditions for the present invention, the quinoline-insoluble content is at most 5% by weight. If a heavy component such as the quinoline-insoluble matter is contained in an amount exceeding 5% by weight, the homogeneity in the carbon fiber spinning pitch will be impaired, and it becomes impossible to produce pitch-type carbon fibers having excellent compression strength. Further, if the carbon fiber spinning pitch containing more than 5% by weight of the quinoline-insoluble content, has a narrow molecular weight distribution so that the glass transition temperature width ($\Delta T_g$) is less than 40° C., the softening point of the pitch will be high, and the temperature required for melt-spinning will be at least 370° C., whereby spinning will be very difficult due to generation of gas bubbles formed by the thermal decomposition reaction. The quinoline-insoluble content in the present invention can be measured by a method of JIS K2421.

The spinning pitch thus obtained is used for the production of carbon fibers in accordance with a conventional method. Such spinning pitch may, for example, be melt-spun at a temperature of from 220° to 400° C., then subjected to infusible treatment under an oxidizing atmosphere, and the resulting fiber strand is subjected to carbonization treatment at a temperature of from 1,500° to 2,000° C., and if necessary, to graphitization treatment at a temperature of from 2,200° to 3,000° C., as the case requires to obtain the desired carbon fibers or graphite fibers. Particularly, the spinning pitch of the present invention is capable of presenting high elastic modulus by baking at a relatively low temperature. In other words, when compared with the same level of baking temperature, carbon fibers having remarkably high elastic modulus can be obtained.

Now, the present invention will be described in further detail with reference to Examples. However, it should be understood that the present invention is by no means restricted to such specific Examples.

EXAMPLE 1

4 kg of naphthalene and 400 g of anhydrous $AlCl_3$ were charged into an autoclave having an internal capacity of 10 l and equipped with a stirrer, and a polycondensation reaction was conducted at 300° C. for one hour in a sealed nitrogen gas atmosphere. The reaction product after removing the catalyst had a quinoline-insoluble content of 0 volume % and was substantially optically isotropic, and it contained some regions wherein an optically anisotropic phase was contained in an amount of about 20 volume %. This product had a softening point of 200° C.

This pitch was subjected to heat treatment at 430° C. for 50 minutes under atmospheric pressure while blowing nitrogen at a blowing rate of 2.4 $Nm^3$/hr into the pitch. The obtained spinning pitch had a temperature of 280° C. at which it showed a viscosity of 200 poise. This pitch was cooled to room temperature and observed by a polarization microscope with 425 magnifications, whereby it showed optical anisotropy of 100 volume %. The quinoline-insoluble content was 2.8% by weight, and the glass transition temperature width ($\Delta T_g$) was 25° C.

Then, this spinning pitch was spun by an extrusion spinning machine having nozzles with a nozzle diameter of 0.1 mm to obtain pitch fibers having a fiber diameter of 11 μm.

Then, the pitch fibers were subjected to infusible treatment at 310° C. in air, and the infusible fibers were heated to 2,050° C. in argon gas and maintained at that temperature for 30 minutes.

The obtained carbon fibers had a fiber diameter of 8.5 μm, a tensile strength of 350 kg/$mm^2$, a tensile elastic modulus of 66 ton/$mm^2$ and a CFRP (carbon-reinforced resin) 0° compression strength at $V_f$ (fiber volume %) of 60% of 60 kg $mm^2$.

EXAMPLE 2

Naphthalene was polymerized at a temperature of from 200° to 300° C. in the presence of a $HF{\cdot}BF_3$ catalyst. After the reaction, the catalyst was recovered in a gas state, and a low boiling point component was removed to obtain a pitch. The optically anisotropic phase was 2 volume % as observed under a polarization microscope, the softening point was 176° C., the quinoline-insoluble content was 1.6% by weight, and the toluene-insoluble content was 34% by weight.

This pitch was treated at 380° C. for 5 hours while blowing nitrogen gas at a rate of 9 $Nm^3$/hr to 1 kg of the pitch. This pitch had an optical anisotropy of 100 volume %, a glass transition temperature width of 28° C. and a quinoline-insoluble content of 3.2% by weight.

Then, this spinning pitch was spun by an extrusion spinning machine having a nozzle with a nozzle diameter of 0.1 mm to obtain pitch fibers having a fiber diameter of 11 μm.

Then, the pitch fibers were subjected to infusible treatment at 310° C. in air, and the infusible fibers were heated to 2,200° C. in argon gas and maintained at that temperature for 30 minutes.

The obtained carbon fibers had a fiber diameter of 8.7 μm, a tensile strength of 329 kg/$mm^2$, a tensile elastic modulus of 59 ton/$mm^2$, and a CFRP 0° compression strength at $V_f$ 60% of 67 kg/$mm^2$.

EXAMPLE 3

Carbon fibers were prepared in the same manner as in Example 2 except that the pitch was heat-treated at 380° C. for 120 minutes while blowing nitrogen gas at a rate of 9 $Nm^3$/hr to 1 kg of the pitch and baking was conducted by heating the infusible fibers to 2,400° C. in argon gas. The pitch had $\Delta T_g$ of 33° C. and Qi (quinoline-insoluble content)

of 1.7% by weight. The carbon fibers had a fiber diameter of 8.9 μm, a tensile strength of 283 kg/mm$^2$, a tensile elastic modulus of 52 ton/mm$^2$, and a CFRP 0° compression strength at $V_f$ 60% of 53 kg/mm$^2$.

COMPARATIVE EXAMPLE 1

A pitch obtained by polymerizing naphthalene at a temperature of from 200° to 300° C. in the presence of a $HF.BF_3$ catalyst and having an optically anisotropic phase of 100% and a softening point of 248° C., was spun and baked for infusible treatment in the same manner as in Example 1 to obtain carbon fibers, whereby the fiber diameter was 7.2 μm, the tensile strength was 269 kg/mm$^2$, the tensile elastic modulus was 53 ton/mm$^2$, and the CFRP 0° compression strength at $V_f$ 60% was 40 kg/mm$^2$. The pitch had $\Delta T_g$ of 46° C. and Qi of 19% by weight.

EXAMPLE 4

Naphthalene was polymerized at a temperature of from 200° to 400° C. in the presence of a $HF.BF_3$ catalyst to obtain a pitch which has an optical anisotropy of 100 volume % as observed under a polarization microscope, an optically anisotropic structure of a "rough flow type", a glass transition temperature width ($\Delta T_g$) of 52° C., a quinoline-insoluble content of 18.5% by weight, a Mettler softening point of 250° C. and an elemental composition as analyzed of C: 94.8 wt % and H: 5.2 wt %. This pitch was finely pulverized. Then, 200 ml of pyridine was added to 5 g of this pitch, and extraction was conducted at 100° C., followed by filtration with a 0.05 μm membrane filter to remove the pyridine-insoluble matter. Then, from the soluble matter, pyridine was removed to obtain a pyridine-soluble pitch.

Then, a solvent mixture of toluene/hexane=40 volume %/60 volume % was added in an amount of 150 ml to 3 g of this pyridine-soluble pitch, and extraction was conducted at 70° C., followed by filtration with a 0.5 μm membrane filter to remove the soluble matter. From the insoluble matter, solvent was removed to obtain a spinning pitch.

The obtained spinning pitch had a temperature of 278° C. at which it showed a viscosity of 200 poise, and it was kept to stand at this temperature for 20 minutes, then cooled to room temperature and observed by a polarization microscope with 425 magnifications, whereby it was found to have a rough flow structure in its entirety and have an optical anisotropy of 100 volume %.

This pitch had less than 1% by weight of a quinoline-insoluble content, and a DSC curve was measured in accordance with the method of JIS K7121-1987 by means of SSC 580 Series DSC-20 Model apparatus, manufactured by Seiko Denshi K.K. Specifically, an aluminum dish was used as a sample dish, and an empty aluminum dish was used also for the standard substance. Under a nitrogen gas stream of 50 ml/min, 15 mg of the spinning pitch was preliminarily heat-treated at 350° C. and then rapidly cooled to room temperature, and measurement was conducted by heat-treating it at a constant temperature rising rate of 15° C./min. The glass transition temperature width ($\Delta T_g$) thus obtained was 32° C.

Then, this spinning pitch was spun by an extrusion spinning machine having nozzles with a nozzle diameter of 0.1 mm to obtain pitch fibers having a fiber diameter of 11 μm.

Then, the pitch fibers were subjected to infusible treatment at 310° C. in air.

The fibers thus treated by infusible treatment, were heated to 1,950° C. in argon gas and maintained at that temperature for 30 minutes.

The obtained carbon fibers had a fiber diameter of 8.3 μm, a tensile strength of 350 kg/mm$^2$, a tensile elastic modulus of 65 ton/mm$^2$ and a DFRP 0° compression strength at $V_f$ 60% of 65 kg/mm$^2$ as measured in accordance with a testing method prescribed in ASTM-D3410.

EXAMPLE 5

A spinning pitch was prepared in the same manner as in Example 4 except that treatment was conducted by using a solvent mixture of toluene/hexane=30 volume %/70 volume % to 3 g of the pyridine-soluble pitch. The obtained spinning pitch had a temperature of 264° C. at which it showed a viscosity of 200 poise and an optical anisotropy of 75 volume % as observed by a polarization microscope in the same manner as in Example 4.

This pitch had a quinoline-insoluble content of at most 1% by weight and a glass transition temperature width ($\Delta T_g$) of 35° C.

Then, this spinning pitch was spun by an extrusion spinning machine having nozzles with a nozzle diameter of 0.1 mm to obtain pitch fibers having a fiber diameter of 11 μm.

Then, the pitch fibers were subjected to infusible treatment at 310° C. in air. The infusible fibers were heated to 2,050° C. in argon gas and maintained at that temperature for 30 minutes.

The obtained carbon fibers had a fiber diameter of 8.5 μm, a tensile strength of 350 kg/mm$^2$, a tensile elastic modulus of 66 ton/mm$^2$, and a CFRP 0° compression strength at $V_f$ 60% of 60 kg/mm$^2$.

COMPARATIVE EXAMPLE 2

A pitch prepared from naphthalene and having an optical anisotropy of 100%, a glass transition temperature width ($\Delta T_g$) of 52° C., a quinoline-insoluble content of 18.5% by weight and a Mettler softening point of 250° C., as used in Example 4, was spun and baked for infusible treatment in the same manner as in Example 4 to obtain carbon fibers.

The obtained carbon fibers had a fiber diameter of 7.2 μm, a tensile strength of 270 kg/mm$^2$, a tensile elastic modulus of 53 ton/mm$^2$, and a CFRP 0° compression strength at $V_f$ 60% of 40 kg/mm$^2$.

COMPARATIVE EXAMPLE 3

A solvent mixture of toluene/hexane=60 volume %/40 volume % (solubility parameter: 8.2) was added in an amount of 200 ml to 5 g of a pitch prepared from naphthalene and having an optical anisotropy of 100% and a Mettler softening point of 250° C., as used in Example 4, and extraction was conducted at a temperature of 70° C., followed by filtration with a 0.5 μm membrane filter to remove a soluble matter. From the insoluble matter, the solvent was removed to obtain a spinning pitch.

The obtained spinning pitch had a temperature of 323° C. at which it showed 200 poise, and optical anisotropy of 100 volume %, a glass transition temperature width ($\Delta T_g$) of 38° C., and a quinoline-insoluble content of 24.3% by weight.

Then, this spinning pitch was spun and baked for infusible treatment in the same manner as in Example 4 to obtain carbon fibers.

The obtained carbon fibers had a fiber diameter of 9.0 μm, a tensile strength of 250 kg/mm$^2$, a tensile elastic modulus of 67 ton/mm$^2$, and a CFRP 0° compression strength at $V_f$ 60% of 40 kg/mm$^2$.

EXAMPLE 6

Naphthalene was polymerized at a temperature of from 200° to 400° C. in the presence of a $HF.BF_3$ catalyst to obtain a pitch which had an optical anisotropy of 100% as observed under a polarization microscope, an optical anisotropic structure of a "rough flow type", a Mettler softening point of 250° C. and an elemental composition as analyzed of C: 94.8 wt % and H: 5.2 wt %. This pitch was finely pulverized. Then, pyridine (solubility parameter: 10.6) was added in an amount of 200 ml to 5 g of this pitch, and extraction was conducted at 100° C., followed by filtration with a 0.5 μm membrane filter to remove a pyridien-insoluble matter. Then, from the soluble matter, pyridine was removed to obtain a pyrildine-soluble pitch. The pitch had $\Delta T_g$ of 33° C. and Qi of not more than 1% by weight.

Then, a solvent mixture of toluene/hexane=20 volume %/80 volume % (solubility parameter: 7.6) was added in an amount of 150 ml to 3 g of said pyridine-soluble pitch, and extraction was conducted at about 70° C., followed by filtration with a 0.5 μm membrane filter to remove a soluble matter. From the insoluble matter, the solvent was removed to obtain a spinning pitch.

Figure 2:
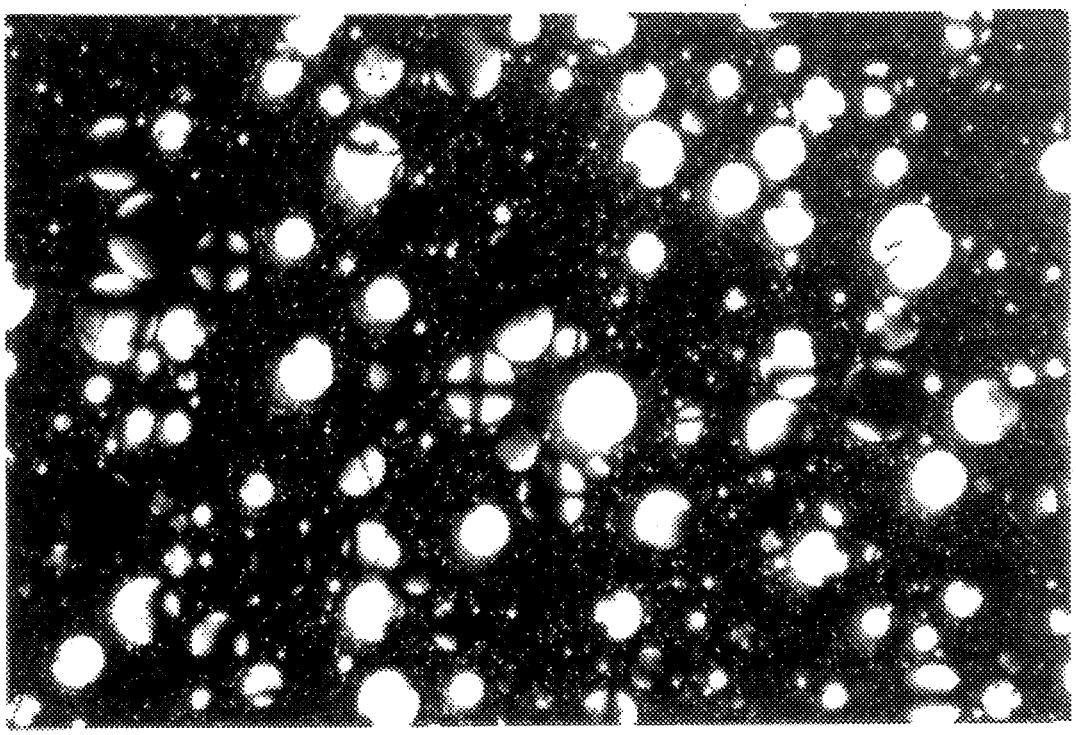
FIG. 2 is a polarization microscopic photograph (crystal structure) (photographed without a gypsum plate) of one embodiment of the spinning pitch prepared by the present invention. The photograph was taken with an objective lens: ×20 and a photographic projection lens: ×5 (425 magnifications on the photograph).

The obtained spinning pitch was embedded into a resin and polished by a conventional method and photographed by a polarization microscope with an objective lens: ×20 and a photographic projection lens: ×5 and observed on a polarization microscopic photograph with 425 magnifications on the photograph (FIG. 2), whereby numerous optically anisotropic fine spherical particles were observed as dispersed, and among them, optically anisotropic fine spherical particles with a diameter of larger than 3 μm constituted 30% of the entirety.

Further, the same sample was photographed with a gypsum plate inserted and with an objective oil immersion lens: ×100 and a photographic projection lens: ×5 and observed on a polarization microscopic photograph with 2,700 magnifications, whereby numerous optically anisotropic fine spherical particles with a diameter of from 0.2 to 3 μm with the majority being from 0.3 to 1.0 μm were found as dispersed or concentrated. The optically anisotropic proportion was measured by a method in which the diameters and the number of optically anisotropic fine spherical particles per 4 $cm^2$ of the polarization microscopic photograph with 2,700 magnifications (per 7.4 μm ×7.4 μm on the actual sample) (FIG. 3) were counted, whereby the optically anisotropic proportion was found to occupy 40 volume % of the remaining portion.

Further, the temperature at which the spinning pitch showed a viscosity of 200 poise, was 250° C. The spinning pitch was heated on a hot stage in a nitrogen atmosphere and observed by a polarization microscope with an objective lens: ×20 and an eyepiece: ×10, whereby the volume proportion of the optically anisotropic portion in the molten pitch with a viscosity of 200 poise at 250° C. was not higher than 1%.

Then, this spinning pitch was spun by an extrusion spinning machine having nozzles with a nozzle diameter of 0.1 mm to obtain pitch fibers having a fiber diameter of 11 μm.

Then, the pitch fibers were subjected to infusible treatment at 310° C. in air.

The fibers thus treated by infusible treatment, was heated to 2,400° C. in argon gas and maintained at that temperature for 30 minutes.

The obtained carbon fibers had a fiber diameter of 8.6 μm, a tensile strength of 350 $kg/mm^2$, a tensile elastic modulus of 60 $ton/mm^2$, and a CFRP 0° compression strength at $V_f$ 60% of 65 $kg/mm^2$.

EXAMPLE 7

Naphthalene was polymerized at a temperature of from 200° to 400° C. in the presence of a $HF.BF_3$ catalyst to obtain a pitch which had an optical anisotropy of 100%, a Mettler softening point of 250° C. and an elemental composition as analyzed of C: 94.8 wt % and H: 5.2 wt %. This pitch was finely pulverized. Then, pyridine (solubility parameter: 10.6) was added in an amount of 200 ml to 5 g of this pitch, and extraction was conducted at 100° C., followed by filtration with a 0.5 μm membrane filter to remove a pyridine-insoluble matter. Then, a solvent mixture of toluene/hexane=40 volume %/60 volume % (solubility parameter: 7.9) was added in an amount of 150 ml to 3 g of the soluble matter, and extraction was conducted at about 70° C., followed by filtration with a 0.5 μm membrane filter to remove a soluble matter. From the insoluble matter, the solvent was removed to obtain a spinning pitch. The pitch had $\Delta T_g$ of 27° C. and Qi of not more than 1% by weight.

The spinning pitch thus obtained was embedded in a resin and polished by a conventional method and then photographed by a polarization microscope with an objective lens: ×20 and a photographic projection eyepiece: ×5 and observed on the polarization microscopic photograph with 425 magnifications, whereby the pitch was found to have a large flow structure in its entirety and an optical anisotropy of 100 volume %.

Then, the spinning pitch was spun in the same manner as in Example 6 by an extrusion spinning machine having nozzles with a nozzle diameter of 0.1 mm and then subjected to infusible treatment at 310° C. in air. Then, the treated fibers were baked in argon gas to obtain carbon fibers.

The obtained carbon fibers had a fiber diameter of 8.3 μm, a tensile strength of 350 $kg/mm^2$, a tensile elastic modulus of 65 $ton/mm^2$, and a CFRP 0° compression strength at $V_f$ 60% of 58 $kg/mm^2$.

COMPARATIVE EXAMPLE 4

A pitch prepared from naphthalene and having an optical anisotropy of 100% and a Mettler softening point of 250° C., as used in Example 6, was spun, subjected to infusible treatment and baked in the same manner as in Example 6 to obtain carbon fibers. The pitch had $\Delta T_g$ of 46° C. and Qi of 19% by weight.

The obtained carbon fibers had a fiber diameter of 7.2 μm, a tensile strength of 270 $kg/mm^2$, a tensile elastic modulus of 53 $ton/mm^2$, and a CFRP 0° compression strength at $V_f$ 60% of 58 $kg/mm^2$.

COMPARATIVE EXAMPLE 5

A solvent mixture of toluene/hexane=60 volume %/40 volume % (solubility parameter: 8.2) was added in an amount of 200 ml to 5 g of a pitch prepared from naphthalene and having an optical anisotropy of 100% and a Mettler softening point of 250° C., as used in Example 6, and extraction was conducted at about 70° C., followed by filtration with a 0.5 μm membrane filter to remove a soluble matter. From the insoluble matter, the solvent was removed to obtain a spinning pitch. The pitch had $\Delta T_g$ of 38° C. and Qi of 24% by weight.

The obtained spinning pitch was observed by a polarization microscopic photograph with 425 magnifications in the same manner as in Example 6, whereby the pitch was found to have a large flow structure in its entirety and have an optical anisotropy of 100 volume %.

Then, this spinning pitch was spun, subjected to infusible treatment and baked in the same manner as in Example 6 to obtain carbon fibers.

The obtained carbon fibers had a fiber diameter of 9.0 μm, a tensile strength of 250 kg/mm$^2$, a tensile elastic modulus of 67 ton/mm$^2$, and a CFRP 0° compression strength at $V_f$ 60% of 40 kg/mm$^2$.

COMPARATIVE EXAMPLE 6

Pyridine (solubility parameter: 10.6) was added in an amount of 200 ml to 5 g of a pitch prepared from naphthalene having an optical anisotropy of 100% and a Mettler softening point of 250° C., as used in Example 6, and extraction was conducted at 100° C., followed by filtration with a 0.5 membrane filter to remove a pyridine-insoluble matter. Then, from the soluble matter, pyridine was removed to obtain a pyridine-soluble pitch.

The obtained spinning pitch was substantially isotropic as observed under a polarization microscope. The pitch had $\Delta T_g$ of 26° C. and Qi of not more than 1% by weight.

Then, the spinning pitch was spun, subjected to infusible treatment and baked in the same manner as in Example 6 to obtain carbon fibers.

The obtained carbon fibers had a fiber diameter of 9.0 μm, a tensile strength of 90 kg/mm$^2$, and a tensile elastic modulus of 7 ton/mm$^2$. Thus, it was impossible to obtain carbon fibers having high elastic modulus and high strength.

COMPARATIVE EXAMPLE 7

A solvent mixture of toluene/hexane=80 volume %/20 volume % (solubility parameter: 7.6) was added in an amount of 200 ml to 5 g of a pitch prepared from naphthalene and having an optical anisotropy of 100% and a Mettler softening point of 250° C., as used in Example 6, and extraction was conducted at a temperature of about 70° C., followed by filtration with a 0.5 μm membrane filter. From the insoluble matter, the solvent was removed to obtain a spinning pitch. The pitch had $\Delta T_g$ of 38° C. and Qi of 24% by weight.

The obtained spinning pitch was observed by a polarization microscopic photograph with 425 magnifications in the same manner as in Example 6, whereby the pitch was found to have a rough flow structure in its entirety and have an optical anisotropy of 100 volume %.

Then, this spinning pitch was spun, subjected to infusible treatment and baked in the same manner as in Example 8 to obtain carbon fibers.

The carbon fibers had a fiber diameter of 9.0 μm, a tensile strength of 250 kg/mm$^2$, a tensile elastic modulus of 67 ton/mm$^2$, and a CFRP 0° compression strength at $V_f$ 60% of 40 kg/mm$^2$.

COMPARATIVE EXAMPLE 8

Coal tar pitch was heat-treated to obtain a spinning pitch having a Mettler softening point of 240° C. and an elemental composition as analyzed of C: 94.8 wt %, H: 3.9 wt % and N: 0.8 wt %.

The spinning pitch thus obtained, was observed by a polarization microscopic photograph with 425 magnifications in the same manner as in Example 6, whereby optically anisotropic fine spherical particles were found as dispersed in an isotropic structure, and among them, optically anisotropic fine spherical particles with a diameter of larger than 3 μm constituted 35% of the entirety. The pitch had $\Delta T_g$ of at least 50° C. and Qi of 0.2% by weight.

Further, the same sample was observed by a polarization microscopic photograph with 2,700 magnifications in the same manner as in Example 6, whereby the portion observed as optically isotropic by the observation with 360 magnifications, was found to be optically isotropic also by the observation under 2,700 magnifications.

Then, using this spinning pitch, spinning was attempted by means of a spinning machine as used in Example 8, whereby it was impossible to constantly obtain pitch fibers with a diameter of 12 μm.

COMPARATIVE EXAMPLE 9

Into an autoclave equipped with a stirrer, a mixture comprising 100 parts of coal-type coal tar pitch having a quinoline-insoluble solid removed, 100 parts of creosote oil, 5 parts of iron oxide and 2.4 parts of sulfur, was continuously supplied and subjected to hydrogenation treatment under a hydrogen pressure of 150 kg/cm$^2$G at a temperature of 420° C. for an average retention time of 1 hour. The treated product was subjected to filtration to remove the iron catalyst, etc. Then, the solvent was distilled off by distillation under reduced pressure to obtain a hydrogenated isotropic pitch.

The hydrogenated pitch was heat-treated at 424° C. for 260 minutes in a nitrogen stream under atmospheric pressure. The obtained spinning pitch was embedded into a resin and polished by a usual method, and then photographed by a polarization microscope ("OPTIPHOT-POL" manufactured by Nikon K.K.) with an objective lens: ×20 and a photographic projection lens: ×5, and it was observed on a polarization microscopic photograph with 425 magnifications, whereby the pitch was found to have a large flow structure, and the proportion of the anisotropic flow structure was found to be 95 volume %. Further, the amount of the quinoline-insoluble matter in this pitch was 28.4% by weight. This spinning pitch was melt-spun, whereby pitch fibers with a diameter of 10 μm were spun without breakage for 2 hours. The obtained pitch fibers were subjected to infusible treatment at 310° C. in air and then baked in argon gas to obtain carbon fibers. The physical properties of the carbon fibers were measured in accordance with a monofilament tensile test method as prescribed in JIS R7601, whereby the fiber diameter was 7.7 μm, the tensile strength was 290 kg/mm$^2$, and the tensile elastic modulus was 52 ton/mm$^2$. Further, the compression strength was measured in accordance with the 0° C. compression strength test method as prescribed in ASTM D3410, whereby the CFRP 0° compression strength at fiber volume % $V_f$ 60% was 39 kg/mm$^2$.

With respect to the spinning pitch used for spinning, a DSC curve was measured in accordance with a method of JIS K7121-1987 by means of SSC 580 Series DSC-20 Model apparatus manufactured Seiko Denshi K.K.. Specifically, an aluminum dish was used as the sample dish, and an empty aluminum dish was used also for the standard substance. The spinning pitch was preliminarily heat-treated at 350° C. under a nitrogen gas stream of 50 ml/min and then rapidly cooled to room temperature. Then, the measurement was conducted by heat-treating it at a constant temperature rising rate of 15° C./min. The glass transition temperature width ($\Delta T_g$) obtained in this manner was 62° C.

EXAMPLE 8

Figure 3:
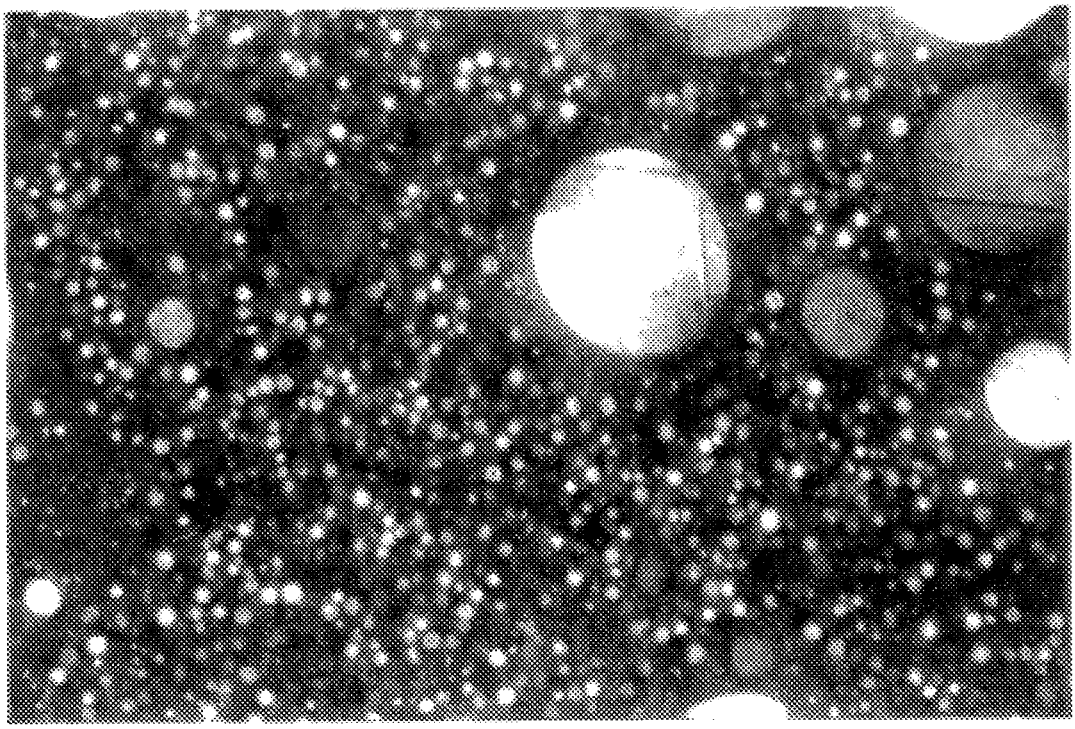
FIG. 3 is a polarization microscopic photograph (crystal structure) where the photograph was taken with an objective oil immersion lens: ×100 and a photographic projection lens: ×5 (2,700 magnifications on the photograph).
Figure 4:
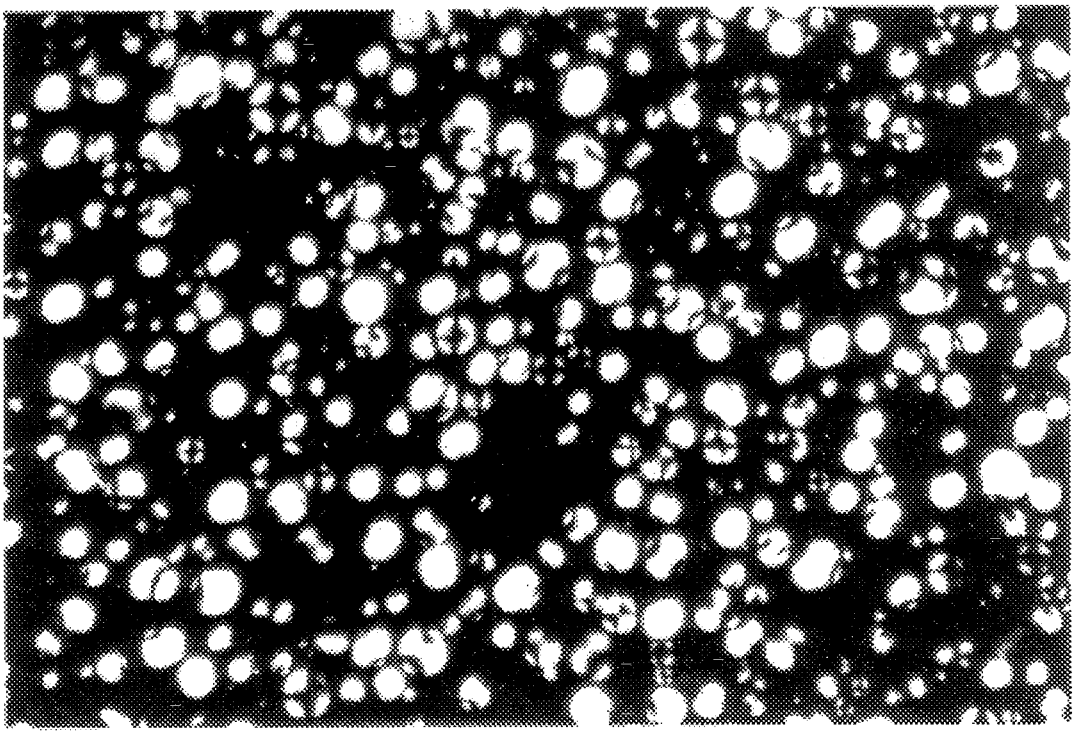
FIG. 4 is a polarization microscopic photograph (crystal structure) of 425 magnifications of the spinning pitch used in Example 1.

A solvent mixture of toluene/hexane=65 volume %/35 volume % was added in an amount of 150 ml to 5 g of a hydrogenated isotropic pitch prepared in the same manner as in Comparative Example 11, and extraction was conducted at about 80° C., followed by filtration with a 0.5 μm membrane filter to remove a soluble matter. From the insoluble matter, the solvent was removed under reduced pressure to obtain a spinning pitch. The obtained spinning pitch was observed by a polarization microscopic photograph in the same manner as in Comparative Example 9, whereby as shown in FIG. 3, the pitch was found to have a structure in which optically anisotropic fine spherical particles with a diameter of from 0.2 to 20 μm were dispersed in an isotropic phase, and such optically anisotropic fine spherical particles occupied 20 volume % of the entirety. Further, the amount of the quinoline-insoluble matter in the pitch was about 0% by weight, and the temperature at which this pitch showed 200 poise, was 345° C. The glass transition temperature width ($\Delta T_g$) obtained from DSC was 34° C. Carbon fibers were prepared from this spinning pitch in the same manner as in Comparative Example 11. The obtained carbon fibers had a fiber diameter of 9.4 μm, a tensile strength of 340 kg/mm$^2$ and a tensile elastic modulus of 58 ton/mm$^2$. Further, the 0° compression strength of the carbon fiber-reinforced resin (CFRP) at a fiber volume % $V_f$=60% was 64 kg/mm$^2$.

COMPARATIVE EXAMPLE 10

Figure 5:
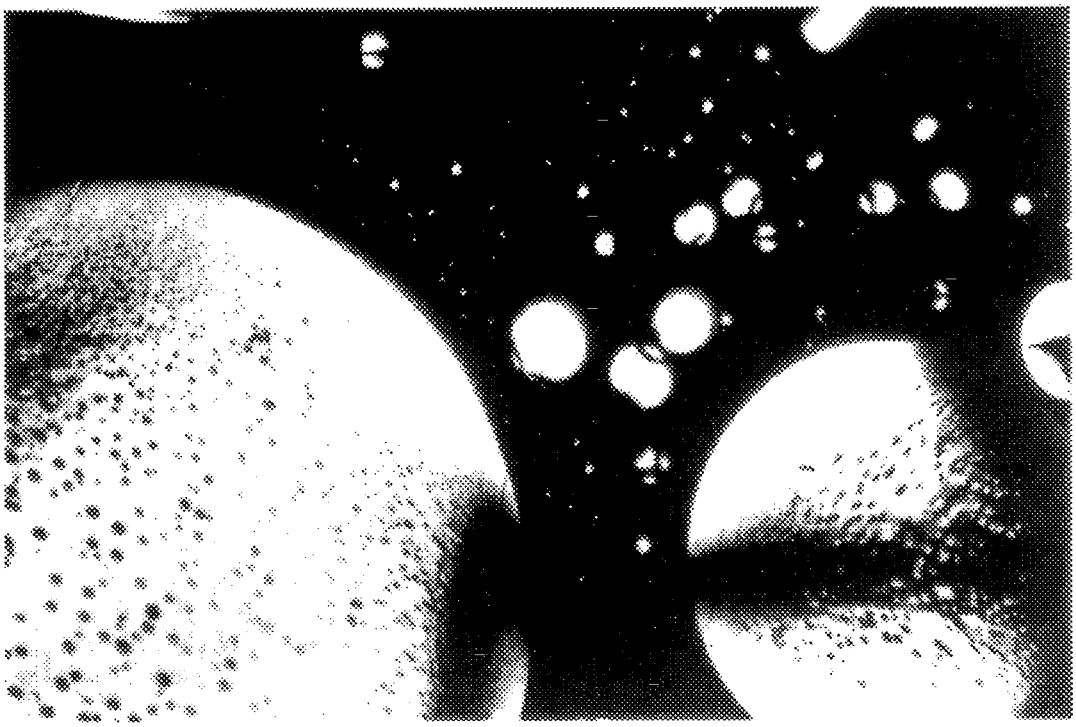
FIG. 5 is a polarization microscopic photograph (crystal structure) of 425 magnifications of the spinning pitch used in Comparative Example 2.

A hydrogenated isotropic pitch obtained by hydrogenating coal tar pitch, was heat-treated at 430° C. for 20 minutes in a nitrogen stream under atmospheric pressure. The obtained spinning pitch was observed by a polarization microscopic photograph in the same manner as in Comparative Example 9, whereby as shown in FIG. 5, the pitch was found to have a structure in which optically anisotropic fine spherical particles with a diameter exceeding 0.2 to 300 μm were dispersed in an isotropic phase, and such optically anisotropic fine spherical particles occupied 30 volume % of the entirety. Further, the amount of the quinoline-insoluble matter in the pitch was 1% by weight, and the temperature at which the pitch showed 200 poise was 280° C. The glass transition temperature width obtained by DSC was 65° C. With this spinning pitch, spinning was attempted in the same manner as in Comparative Example 9, but it was impossible to conduct spinning because of the inconsistent viscosity.

The spinning pitch of the present invention has adequate spinnability and provides carbon fibers having high elastic modulus and high 0° C. compression strength.

We claim:

1. A pitch-based carbon fiber made of a spinning raw material pitch, wherein the temperature at which the spinning raw material pitch shows a shearing viscosity of 200 poise is from 220° to 370° C., the spinning raw material pitch having from 5 to 40% by volume of an optically anisotropic phase relative to the entire volume, and the optically anisotropic phase being dispersed substantially in the form of optically anisotropic spherical particles of from 0.1 to 100 μm, and wherein said carbon fiber has a tensile strength of at least 329 kg/mm$^2$, a tensile modulus of at least 58 ton/mm$^2$, and a CFRP 0° compression strength at $V_f$ 60% of 58 kg/mm$^2$.

2. The pitch-based carbon fiber according to claim 1, wherein the spinning raw material pitch is prepared by obtaining a soluble matter from coal tar pitch by a solvent mixture of toluene/hexane=80 volume %/20 volume to 10 volume %/90 volume %.

3. The pitch-based carbon fiber according to claim 1, wherein the spinning raw material pitch has optically anisotropic particles having a diameter of larger than 3.0 μm constitute from 5 to 40 volume % of the entire volume, and the remaining portion is a portion wherein optically anisotropic particles having a diameter of from 0.2 to 3.0 μm are dispersed, and they constitute from 5 to 100 volume % of said remaining portion.

* * * * *